US007941884B2

(12) United States Patent
Block et al.

(10) Patent No.: US 7,941,884 B2
(45) Date of Patent: May 17, 2011

(54) METHOD FOR OPERATING A WASHING MACHINE HAVING A HEATING UNIT

(75) Inventors: Volker Block, Bretten (DE); Irina Maier, Donaueschingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 12/788,982

(22) Filed: May 27, 2010

(65) Prior Publication Data

US 2010/0263137 A1 Oct. 21, 2010

Related U.S. Application Data

(63) Continuation of application No. PCT/EP2008/009957, filed on Nov. 25, 2008.

(30) Foreign Application Priority Data

Nov. 30, 2007 (DE) ..... 10 2007 058 833

(51) Int. Cl.
*D06F 39/04* (2006.01)

(52) U.S. Cl. ..... 8/149.3; 8/158; 68/5 C; 68/15

(58) Field of Classification Search ..... 68/5 C, 68/15; 8/149.1, 149.2, 149.3, 158, 159
See application file for complete search history.

(56) References Cited

U.S. PATENT DOCUMENTS

| | | | | |
|---|---|---|---|---|
| 1,420,759 | A * | 6/1922 | Sawicki | 392/441 |
| 1,499,605 | A * | 7/1924 | Brown | 68/139 |
| 4,376,378 | A * | 3/1983 | Svenningsen | 68/16 |
| 5,293,761 | A * | 3/1994 | Jang | 68/15 |
| 5,335,523 | A * | 8/1994 | Anastase et al. | 68/16 |
| 5,347,610 | A * | 9/1994 | Lee | 392/447 |
| 7,406,843 | B2 * | 8/2008 | Thies et al. | 68/18 F |
| 7,613,385 | B2 | 11/2009 | Muenzner et al. | |
| 7,705,603 | B2 | 4/2010 | Dorwarth et al. | |
| 2005/0092035 | A1 * | 5/2005 | Shin et al. | 68/275 |
| 2005/0120758 | A1 * | 6/2005 | Thies et al. | 68/18 R |
| 2005/0132757 | A1 * | 6/2005 | Lee et al. | 68/15 |
| 2005/0279141 | A1 * | 12/2005 | Kim | 68/12.22 |
| 2006/0101586 | A1 * | 5/2006 | Park et al. | 8/149 |

(Continued)

FOREIGN PATENT DOCUMENTS

DE 197 49 958 A1 5/1999

(Continued)

OTHER PUBLICATIONS

English Translation of International Preliminary Report on Patentability for Corresponding International Application No. PCT/EP2008/009957 dated Jul. 15, 2010.
International Search Report from PCT/EP2008/009957 dated Mar. 10, 2009.
Office Action for German Application No. 10 2007 058 833.1 dated Jul. 2, 2008.

(Continued)

*Primary Examiner* — Joseph L Perrin
(74) *Attorney, Agent, or Firm* — Alston & Bird LLP

(57) ABSTRACT

The invention in one embodiment relates to a method for operating a washing machine having a heating unit, wherein the heating unit comprises a carrier and at least one planar heating element disposed thereon. At least one first heating element is attached to the carrier in a planar manner, wherein the carrier has a recess extending in the longitudinal direction in the center region. The washing machine has a washing machine barrel and a drum therein, wherein the heating unit is displaced at the bottom in the washing machine barrel outside of the drum. A heating element is provided on the outside of the carrier in the region of the recess in the region along an apex, or along an apex of the recess, wherein only said heating element is operated in the region of the recess for creating steam in the washing machine.

17 Claims, 3 Drawing Sheets

U.S. PATENT DOCUMENTS

| | | | | |
|---|---|---|---|---|
| 2007/0028398 | A1* | 2/2007 | Kwon et al. | 8/158 |
| 2009/0056036 | A1* | 3/2009 | Herkle et al. | 8/149.3 |
| 2009/0077755 | A1* | 3/2009 | Park et al. | 8/137 |
| 2009/0272155 | A1* | 11/2009 | Jeong et al. | 68/5 C |

FOREIGN PATENT DOCUMENTS

| | | | |
|---|---|---|---|
| DE | 100 25 539 | A1 | 11/2001 |
| EP | 0 352 499 | A2 | 1/1990 |
| EP | 0 933 626 | A2 | 8/1999 |

* cited by examiner

METHOD FOR OPERATING A WASHING MACHINE HAVING A HEATING UNIT

CROSS REFERENCE TO RELATED APPLICATIONS

This application is a continuation of PCT/EP2008/009957, filed Nov. 25, 2008, which in turn claims priority to DE 10 2007 058 833.1, filed on Nov. 30, 2007, the contents of which are incorporated by reference.

FIELD OF THE INVENTION

The invention relates to a method for operating a washing machine having a heating unit, in particular for steam generation in the washing machine.

BACKGROUND OF THE INVENTION

It is known from the prior art how to use electric heating units or heating units having electric heating elements arranged in a washing machine barrel of a washing machine underneath a drum. They can be used to heat up water to a required temperature, for example, needed for washing. Usually so-called tubular heaters are used for this purpose, however planar heating elements can also be used.

A problem underlying the invention is to provide a method as mentioned at the outset in which drawbacks in the prior art can be overcome. In particular, the scope of functioning of a washing machine can be expanded without major effort and preferably the heating unit can be used for other purposes.

This problem is solved by a method having the features as claimed herein. Advantageous and preferred embodiments of the invention form the subject matter of the further claims and are explained in greater detail in the following. Some of the features are explained only for the method, the heating unit, or the washing machine. They should however, regardless of this, be applicable for the method. The wording of the claims is made into part of the substance of the description by express reference.

It is provided that the heating unit has a carrier, and at least one planar heating element arranged thereon. The heating element is attached in planar manner to the carrier, where above all the planar or planar-running character of the heating element is important. The carrier has in one region, advantageously in a central region, a recess running over a considerable length or along the carrier. As a result, it is possible, as explained in further detail in the following, to achieve a defined flow of the water off the carrier. Furthermore, a certain concentration of water can be achieved in a certain region in order to permit here, for example, particularly selective and efficient evaporation or heating. The previously described heating unit is arranged at the barrel bottom inside a washing machine barrel between its lower region and the drum. A possible curved form of the heating unit can advantageously be used so that the distance between the drum and the washing machine barrel does not have to be too large. The curvature or radius of the heating unit can match that of the washing machine barrel.

In accordance with one embodiment of the invention, steam is generated in the washing machine or with the heating unit. To do so, only one heating element that is in the region of the recess is operated, as has already been described. This has the effect on the one hand of saving energy, since other heating elements adjacently arranged which normally have less water in their vicinity are not operated as they would be less efficient, contributing considerably less to steam generation. Furthermore, it is in the recess in particular that water can be supplied in, so it can be heated particularly well until evaporation. Here too, a temperature and hence the evaporation can be regulated as well as possible using a temperature sensor. Furthermore, the water intended for evaporation can be supplied to, or sprayed into, the heating unit by an appropriate pump or another similar device in such a way that it collects inside the recess and is completed evaporated before it flows off.

In another embodiment of the invention, the carrier can have in its longitudinal course a longitudinal channel as the stated recess. The longitudinal channel can, as a general principle, have any required design, but is advantageously rounded. It is particularly advantageous when the entire carrier is substantially curved or rounded with a channel form or in the shape of a spade or semi-circular form, and forms the recess itself by its shape. A curvature can be designed substantially uniformly, in particular even over the entire length of the carrier. This means therefore that the water can run off the carrier in the form of a channel particularly well or can previously collect inside it as well as possible. Although it is possible in principle to provide several recesses on the carrier, a single recess is preferred.

The heating unit after installation inside the washing machine can slope in its longitudinal course, preferably slightly obliquely, so that water on it can run off. For this purpose, the channel formed is advantageous here too, since it both effects a certain quantitative concentration of the water on it, or flowing onto it, and also permits a good flow-off. It is particularly advantageous when the heating unit slopes towards its free end. The heating unit can here be advantageously installed such that it runs in its longitudinal direction or in the direction of the recess approximately parallel to a rotation axis of the drum.

Like the recess, at least one heating element of the carrier extends advantageously over its main length. A heating element of this type can be provided either as a full surface, or cover a surface and be designed for example in a meandering shape.

Although it is possible, as a general principle, to provide heating elements on both sides of the carrier, advantageously one heating element is provided on the outside, i.e., topside of the carrier, i.e., in the region where the recess projects beyond the course of the carrier, or along an apex, or along an apex line of the recess. In this way it can be achieved that when the heating unit is installed in the washing machine, the recess or its said apex line forms the lowest point of the heating unit. This is where the water collects. The water can run off on one side; however in any event it is in this region in which the water remains longest that the heating element is arranged for optimum heating up or evaporation of this water. The arrangement of the heating element on the outside of the carrier or in the installed state on the underside also has the advantage that lime deposits or the like are not directly present on the heating element, but only on the carrier surface. It is particularly advantageous when all heating elements are provided on the same side, i.e., on the outside or underside.

In another embodiment of the invention, at least one first heating element is provided as stated above inside the region of the recess, and at least one second heating element is located adjacently towards the lateral edge or longitudinal side of the carrier. It is particularly advantageous when second heating elements are provided on both sides of the first heating element and in particular are designed identically and of identical size. It is advantageous here when the first heating element and the second heating elements can each be operated separately from one another depending on the required operating mode. This is described in more detail in the following section.

In another embodiment of the invention, a temperature sensor can be provided on the carrier. This too can be designed using thick-film technology. The temperature sensor is, like the heating elements, advantageously provided on the carrier on the outside or underside of the recess, in particular precisely at the recess. In this way, the temperature sensor can measure the temperature of the heating unit and above all of the heating element at the recess, and a water temperature can be deduced from this when the heating element is completely immersed in water for heating mode or for determining a temperature for evaporation mode. In another embodiment of the invention, two such temperature sensors are provided, both on the same side. It can here be advantageous to provide the temperature sensors in each case close to one end of the carrier, in particular in each case at the recess. This enables the temperature of the heating unit to be well regulated particularly during the evaporation mode in accordance with the invention. An alternative possibility for temperature measurement or as a substitute for the temperature sensors is to measure the electric resistance of the heating unit, as is generally known to a person skilled in the art. This electric resistance can be an NTC (negative temperature coefficient) or a PTC (positive temperature coefficient) resistor in particular for better measurement.

In a further embodiment of the invention, a conductivity measuring device can be provided on the carrier. It can for example be designed using thick-film technology and have two electrodes covered by a top layer and protected against the washing liquid or washing suds. Such conductivity measuring devices are generally known from the prior art, see for example U.S. Pat. No. 7,613,385 or U.S. Pat. No. 7,705,603. This conductivity measuring device can be used to ascertain properties of the washing liquid in particular the degree of soiling or the like.

In a further embodiment of the invention, the carrier can have a function layer. This can for example have an anti-stick effect, in particular in the manner of a PTFE (polytetrafluoroethylene) layer. Further functions can be insulating properties for electrical insulation or resistance to aggressive media such as water, steam or lime, in particular in the washing liquid. An above function layer with anti-stick effect is advantageous particularly on the upper side of the heating unit, so that no deposits can form from the water on it.

A heating capacity of slightly less than 1000 W can be achieved by the heating unit at the heating element along the recess. The heating capacity is advantageously less than 800 W, since the switching or cycling of the individual heating elements is possible as often as required in accordance with the regulations of the energy suppliers. A total capacity of up to more than 2000 W can be achieved by heating elements arranged adjacently.

In a further operating mode of the heating unit or washing machine, it can be operated such that the water in the washing machine or in the washing machine barrel is to be heated for a washing operation. All heating elements of the heating unit are then advantageously operated/controlled, their precise operation being handled by the above temperature sensors.

These and further features can be gathered from the claims, description and drawings, where the individual features, both singly or severally in the form of subcombinations, can be implemented in an embodiment of the invention and in other fields and can represent advantageous and independently protectable designs for which protection is claimed here. The subdivision of the application into individual sections and the subheadings in no way restrict the general validity of the statements made thereunder.

BRIEF DESCRIPTION OF THE DRAWINGS

Embodiments of the invention are shown hereinafter substantially schematically in the drawings and are explained in detail in the following. The drawings show in.

DETAILED DESCRIPTION OF EMBODIMENTS

Figure 1:
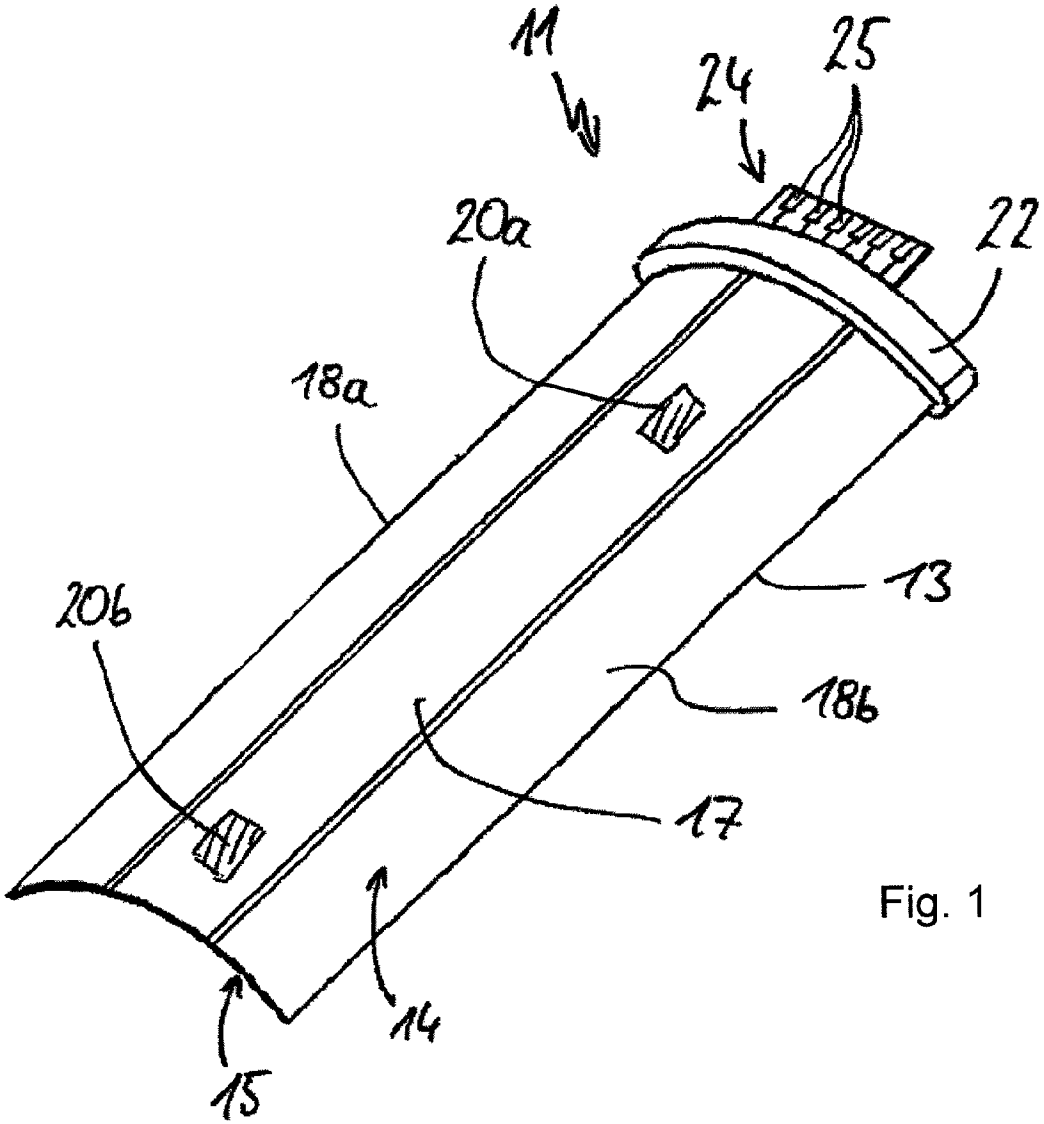
FIG. 1 an oblique view from below onto an embodiment of the heating unit.
Figure 2:
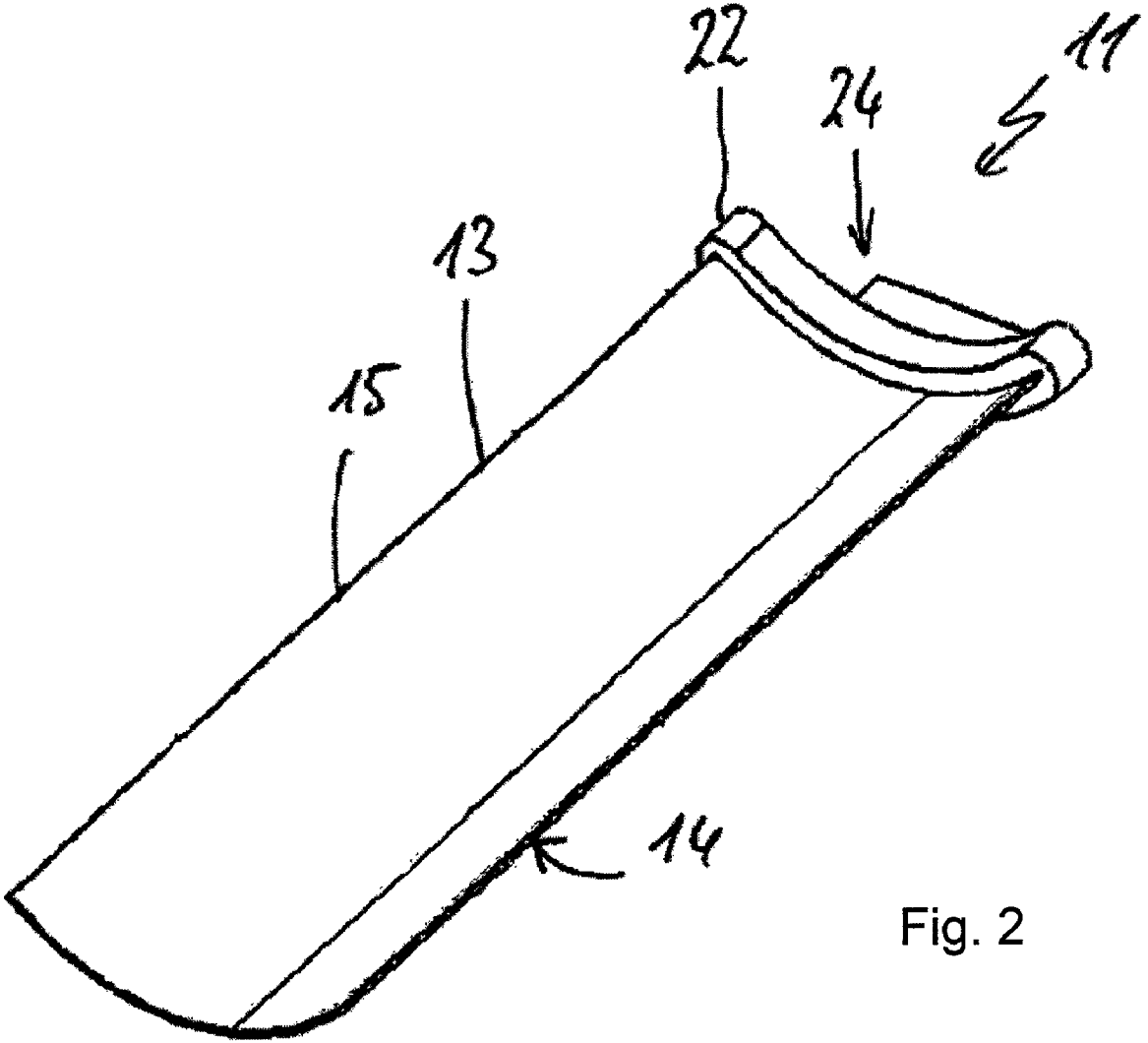
FIG. 2 an oblique view from above onto the heating unit in accordance with FIG. 1, FIG. 3 the installation situation of the heating unit from FIG. 1 into a washing machine from the front, and FIG. 4 the installation in accordance with FIG. 3 in a side view.
Figure 4:
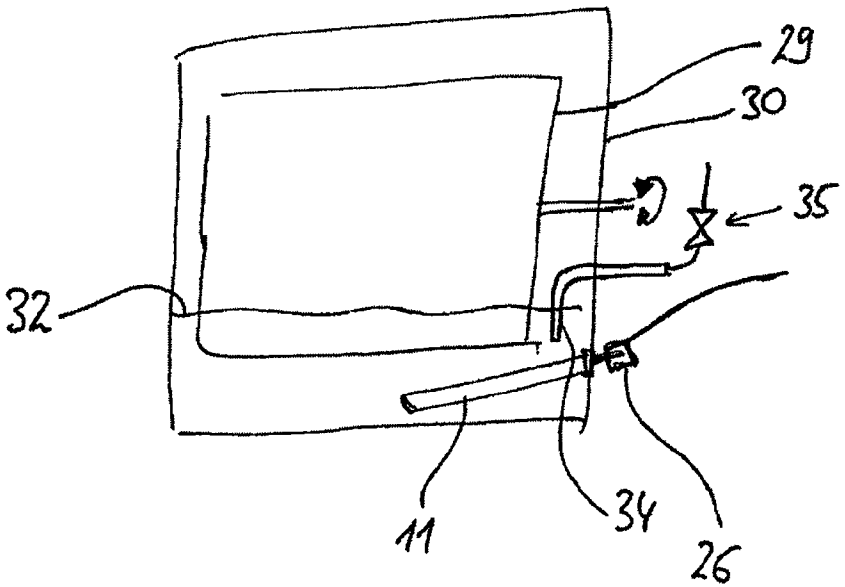
Figure 3:
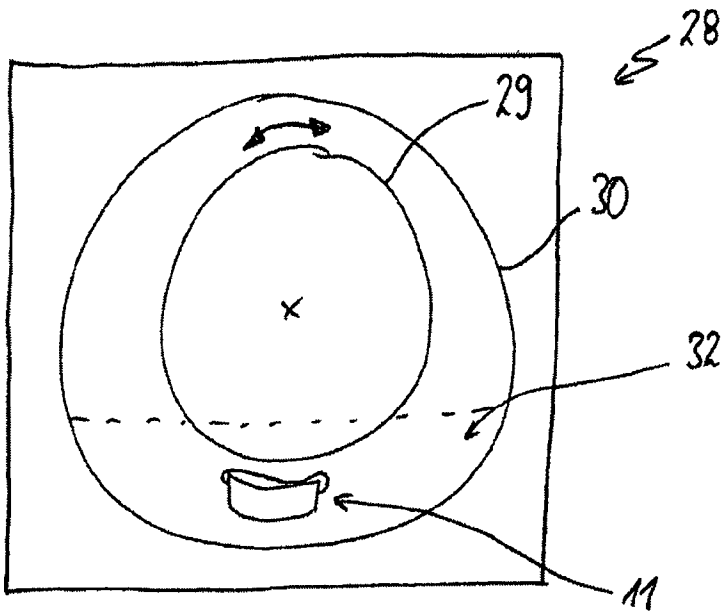

FIG. 1 shows a heating unit 11 in accordance with the invention in an oblique view from below. The unit comprises a carrier 13 designed elongated and curved in the manner of a round channel. The carrier 13 is advantageously made from a steel suitable for such applications, for example coated with an appropriate insulating layer containing glass or comprising enamel. This is known from EP 933 626 A2. An insulating layer of this type is as a rule advantageously provided on the outside 14, which in the installed state in accordance with FIGS. 3 and 4 is underneath, and possibly also on the inside 15.

The carrier 13 has on the outside 14, i.e., practically at the apex of the channel, an elongated first heating element 17. This is shown as a surface, but can also be designed differently in detail, for example with the aforementioned elongated meandering form or the like. A second heating element 18*a* and a third heating element 18*b* are provided on both sides, separated by trenches or with a certain spacing. These elements can in principle be designed similar, i.e., either full-surface or meandering. Furthermore, the heating elements can have the same capacity, but also in some embodiments they can have differing capacities. In particular, the first or middle heating element 17 can have the highest capacity.

Furthermore, a temperature sensor 20*a* can be provided near to one end in the region of the first heating element 17 or along the apex line of the channel of the carrier 13, and a temperature sensor 20*b* near to the other end. These are designed as standard temperature sensors using thick-film technology, in particular for temperature measurement by resistance measurement.

Both the heating elements 17, 18*a* and 18*b* and the temperature sensors 20*a* and 20*b* are connected via paths, not shown, on a projecting region 24 of the carrier 13 at its one end to connector panels 25. The connector panels 25 are designed here as metallized areas on the carrier 13 in the region 24 and permit attachment of a group connector for electric connection, as shown in FIG. 4. The projecting region 24 is separated from the rest of the carrier 13 by an all-round gasket 22. This gasket 22 consists of rubber and is sprayed directly onto or around the carrier 13 by two-component spraying. In this way, a good sealing effect and a good mechanical strength of the construction unit are assured. Alternatively and also advantageously, the heating unit 11 can be sprayed around with a plastic flange so that it can be fitted directly inside a washing machine barrel. The plastic flange is then the second component. In this way a good sealing function can also be achieved.

FIG. 3 shows a washing machine 28 in a sectional view from the front. It has in the usual way a drum 29 inside a washing machine barrel 30. The drum 29 can here rotate about the central rotation axis. In the cavity between the drum 29 and the washing machine barrel 30, the heating unit 11 in accordance with FIG. 1 is arranged in the lower region and so is completely immersed in the washing liquid 32, which naturally collects in the lower region of the washing machine barrel 30. The side view from FIG. 4 makes clear how a connecting plug 26 is attached at the projecting region 24 with the connector panels 25 in accordance with FIG. 1 for electric connection of the entire heating unit 11, i.e., both of the heating elements 17, 18*a* and 18*b* and of the temperature sensors 20*a* and 20*b*. The downward-sloping installation of the heating unit 11 into the washing machine 28 is determined in accordance with the invention by the installation situation, and in some circumstances appropriate supports or holders can be provided. This sloped position has the effect that during pumping off of the washing liquid 32 the water flows well off the heating unit 11, so that no residues and hence fouling result. As a result, the heating effect of the heating unit 11 in the washing liquid 32 is not impaired.

For the evaporation mode in accordance with the invention, it is possible via an intake pipe 34 with valve 35 not only to supply water to the washing machine 28 generally for washing but also, when the washing machine barrel 30 is dry, and to supply a small quantity of water metered by the valve 35 via the intake pipe 34 arranged precisely above the heating unit 11 near to the gasket 22. In so doing, not all heating elements, i.e., all three, are operated as during heating mode to heat up the washing liquid 32, but only the first heating element 17. The latter thus heats the central region that contains a small quantity of water reaching the inside 15 of the heating unit 11 and flowing off towards the free end. This water can thus be evaporated by strong and rapid heating, so that steam spreads out inside the washing machine 28 and above all inside the drum 29. This steam can be used for a special treatment of washed items contained therein, for example for freshening them. The channel form of the heating unit 11 has the effect of collecting the water precisely in the vicinity of the apex of the channel, and thus at the middle heating element. Furthermore, it is possible thanks to the sloping arrangement of the heating unit to achieve here too the movement and distribution of water over the entire first heating element 17.

Using the temperature sensors 20*a* and 20*b* on the heating unit 11, the energy input can be regulated by measurement of the temperature, depending on steam generation mode or on heating mode of the heating unit 11. Furthermore, a measurement of the properties of the washing liquid can be performed by a conductivity measuring device. Finally, it is also possible to provide the inside or topside 15 of the carrier 13, at which in the embodiment here neither heating elements nor other sensors are provided, with an anti-stick coating mentioned at the outset. In this way too, deposits can be prevented or at least greatly reduced in addition to the sloped installation.

The invention claimed is:

1. A method for operating a washing machine having a heating unit for generating steam, wherein said heating unit has a carrier having a top side and a bottom side, and at least one heating element, wherein said at least one heating element is attached to said carrier, wherein said carrier has a central region and in said central region a recess runs lengthways, wherein said washing machine has a washing machine barrel with an inside barrel bottom and a drum inside said washing machine barrel, wherein said heating unit is arranged above said inside barrel bottom, and outside and below said drum, such that said top side faces up, wherein said one heating element is provided on said bottom side of said carrier in a region along said recess, wherein said at least one heating element in said region of said recess is operated for steam generation inside said washing machine, wherein said heating unit is positioned in said washing machine barrel at a slope and said heating unit has a longitudinal direction, said method comprising the steps of:

heating said at least one heating element; and providing water from a supply line over said heating element, such that said water flows along said longitudinal direction of said heating unit at said slope thereby generating steam.

2. The method according to claim 1, wherein at least one temperature sensor is provided on said carrier, wherein said temperature sensor is provided on said bottom side of said recess on said carrier, wherein said temperature of said heating unit is measured using said temperature sensor for control of said heating element, further comprising the step of:

regulating power to said heating unit depending on said temperature.

3. The method according to claim 2, wherein two temperature sensors are provided on said bottom side of the carrier, where one said temperature sensor is provided close to one end of said carrier and said other temperature sensor is provided close to the other end of said carrier in its longitudinal course parallel to said recess.

4. The method according to claim 1, further comprising the steps of:

measuring an electrical resistance of said heating element; and determining a temperature of said heating element or of said carrier using said measured electrical resistance.

5. The method according to claim 1, further comprising the step of:

operating all said heating elements of said heating unit for heating said water.

6. The method according to claim 1, wherein said heating unit is located in a lowest region of said washing machine barrel.

7. The method according to claim 1, wherein said heating unit is installed inside said washing machine such that said recess channels said water in said recess.

8. The method according to claim 1, wherein said recess extends over the majority of a length of said carrier.

9. The method according to claim 1, wherein said carrier has in its longitudinal course a longitudinal channel to form said recess.

10. The method according to claim 9, wherein said recess is a rounded longitudinal channel, substantially curved overall with a channel form in a semi-circular profile.

11. The method according to claim 1, wherein said longitudinal direction of said heating unit is not parallel to a rotation axis of said drum.

12. The method according to claim 1, wherein at least said first heating element extends in a region of said recess over a major part of a length of said carrier.

13. The method according to claim 1, wherein said heating element is provided in a region of said recess, wherein a second heating element is adjacent to said first heating element and parallel to a first lateral edge, and wherein a third heating element is adjacent to said first heating element and parallel to a second lateral edge.

14. The method according to claim 13, wherein said first heating element and said second heating element are operated separately.

15. The method according to claim 1, wherein a thick-film conductivity measuring device is provided on said carrier comprising two electrodes and a top layer covering said conductivity measuring device, wherein said conductivity measuring device is provided on a bottom side of said carrier.

16. The method according to claim 1, wherein a heating capacity of said first heating element at said recess is less than 800 W.

17. A system for generating steam in a washing machine comprising:

a washing machine barrel horizontally oriented along a first axis, said washing machine barrel having a bottom inside of said barrel;

a drum having a horizontal axis of rotation, said drum positioned inside said washing machine barrel;

a carrier comprising at least one planar heating element arranged on said carrier, said carrier having a recess running lengthways along said carrier, wherein said carrier is positioned between said bottom inside of said barrel and a bottom of said drum, wherein said carrier is further positioned below said axis of rotation with a slope running lengthways such that water supplied by a water supply line over said carrier runs off said carrier; and a first heating element attached to said carrier configured to heat said water when said water runs off said carrier thereby producing steam.

* * * * *